United States Patent [19]

Rowley

[11] 3,970,000

[45] July 20, 1976

[54] LABEL STOCK OVERPRINTING MACHINE

[75] Inventor: Jack Rowley, Congleton, England

[73] Assignee: Berisfords Limited, Congleton, England

[22] Filed: Dec. 6, 1974

[21] Appl. No.: 530,135

[30] Foreign Application Priority Data

Sept. 12, 1974 United Kingdom ..... 39771/74

[52] U.S. Cl. ..... 101/181; 101/235

[51] Int. Cl.[2] ..... B41F 5/06; B41F 5/16

[58] Field of Search ..... 101/178, 181, 184, 233, 101/234, 235, 245

[56] References Cited

UNITED STATES PATENTS

| | | | |
|---|---|---|---|
| 1,186,562 | 6/1916 | Ewers | 101/178 |
| 1,983,921 | 12/1934 | Persson | 101/235 |
| 2,683,413 | 7/1954 | Muller | 101/235 |
| 3,026,797 | 3/1972 | Gottscho | 101/245 X |
| 3,461,798 | 8/1969 | Bulk et al. | 101/184 |
| 3,537,393 | 11/1970 | Hegi | 101/235 |
| 3,641,313 | 2/1972 | Watson | 101/235 UX |

*Primary Examiner*—Anton O. Oechsle

*Attorney, Agent, or Firm*—Ross, Ross & Flavin

[57] ABSTRACT

For printing continuous woven label stock (i.e. a web consisting of a plurality of woven labels connected together end-to-end) a printing machine comprises a support which supports the label stock and progresses it past a printing station having a printing head including a printing roller adapted to be rotated in synchronism with the moving stock sufficiently for a single printing operation upon passage of each label, driving of the printing head being initiated by a sensor which senses a datum mark on each label. For printing a plurality of colors, there may be a number of such printing heads, driving of each successive one of such printing heads being initiated by rotation of the preceding printing head.

7 Claims, 4 Drawing Figures

LABEL STOCK OVERPRINTING MACHINE

This invention concerns a machine for overprinting continuous woven label stock, that is to say a continuous woven web consisting of a plurality of woven labels connected together end-to-end.

Existing methods of overprinting such continuous woven label stock are generally capable only of printing the web with a single colour and involve progressing the web stepwise, bringing it to a stop for each successive printing operation. Because the web has to be arrested between successive printing operations, the known methods are of relativley low productive capacity, for example of the order of 100 labels per minute.

In practice, it is often required to be able to overprint data (e.g. variable data such as size, washing instructions and so on) in various different colours upon woven labels in continuous woven label stock, but such overprinting involves substantial difficulties arising from the fact that the labels in continuous label stock vary considerably in length from label to label, these difficulties having hitherto been considered to be almost insurmountable where overprinting in two or more different colours is concerned.

An object of the present invention is to provide a machine which enables the labels in woven label stock to be overprinted at a considerably faster rate than has hitherto been possible, and also can be constructed so as to enable accurate multi-coloured overprinting to be effected upon label stock at a rapid production rate in a relatively simple and effective manner.

With this object in view the present invention provides a machine for overprinting continuous woven label stock comprising a support for supporting the label stock and progressing it past a printing station whereat is a printing head comprising a printing roller carrying an impression of data to be printed and an inking arrangement, said printing roller being adapted to be driven sufficiently for a single printing operation upon the passage of each label through the printing station, driving of said printing roller being initiated by sensor means for sensing a datum mark on each label.

For enabling the woven label stock to be printed with a plurality of colours the printing station preferably comprises a plurality of said printing heads, one for each colour to be printed, each said printing head comprising a respective said printing roller carrying a respective impression of the respective data to be printed and a respective inking arrangement, said printing roller being adapted to be driven successively and sufficiently for respective single printing operations upon the passage of each label through the printing station, driving of the first of the printing rollers being initated by said sensor means which serves to sense the datum mark on each label, and the driving of each succeeding printing roller being initiated from the rotation of the preceding printing roller.

Preferably each printing roller comprises a respective continuously-driven element adapted to drive its respective printing roller by way of a respective clutch including a ratchet toothed disc which rotates with its printing roller and a respective pawl which co-operates with the toothed wheel and disengages therefrom to permit rotation of the printing roller for each successive single printing operation.

In such an arrangement, the pawl of the first printing roller will, of course, be adapted to be disengaged from its toothed disc by the sensor means; the pawls of the succeeding printing rollers may conveniently be adapted to be disengaged from their respective discs by respective cam lobes on the disc of the preceding printing roller.

The support for supporting the label stock may conveniently comprise a resiliently-tired roller of diameter substantially greater than the diameters of the printing rollers.

In order that the invention may be fully understood, it will be described further, by way of example, with reference to the accompanying drawings, in which.

Figure 1:
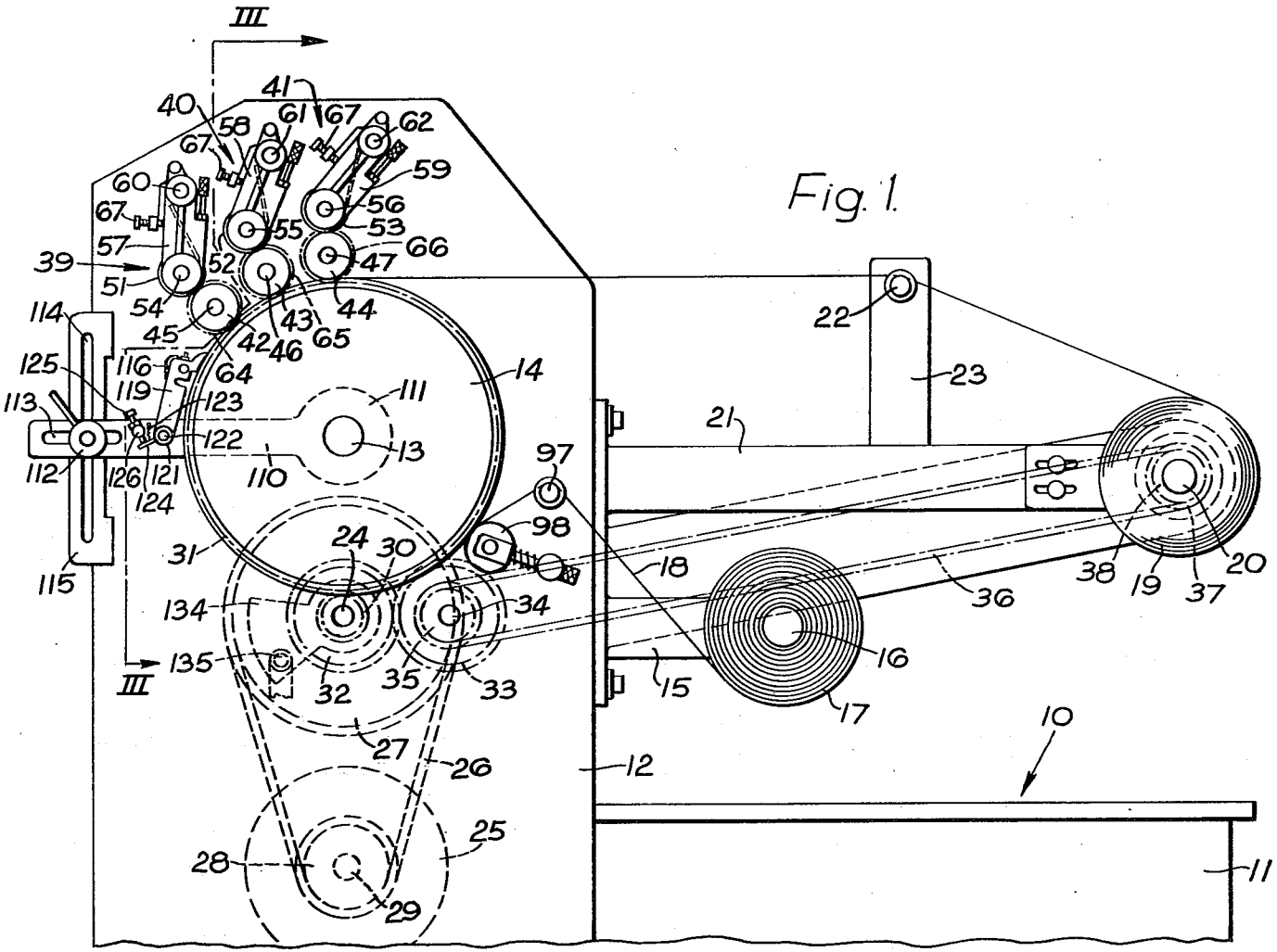
FIG. 1 is a fragmentary front view of a preferred embodiment of the machine of the invention.
Figure 2:
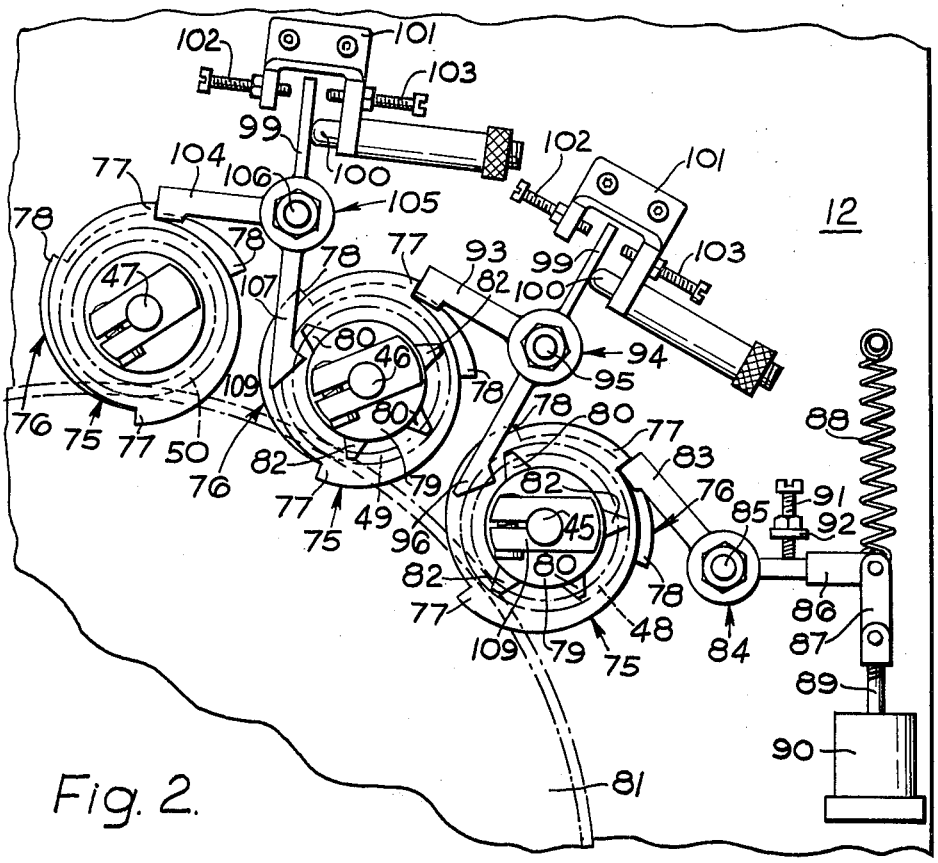
FIG. 2 is an enlarged fragmentary rear view illustrating part of the machine of FIG. 1.

The illustrated preferred embodiment of the machine conforming to the invention is for three-colour overprinting of labels in continuous woven label stock and comprises a machine frame, indicated generally by the numeral 10, providing a bottom housing 11 above which is a substantially vertical mounting plate 12 through which extends a horizontal shaft 13 which carries a large-diameter resiliently-tired support roller 14. Journalled in a lower horizontal mounting arm 15 bolted to the plate 12 so as to be spaced horizontally from the roller 14 is a feed-off spindle 16 for carrying a reel 17 of continuous woven label stock from which a web 18 of woven labels progresses by way of a guide roller 97 and a pressure roller 98 to meet the support roller 14 near to its lowest point, whereupon it passes firstly downwards and then upwards around the support roller 14 and then approximately horizontally to an idler roller 22 after which it passes to a take-up reel 19 on a take-up spindle 20 journalled in an upper horizontal mounting arm 21 disposed above the arm 15, the intermediate idler roller 22 being mounted on a bracket 23, secured to the arm 21.

A main drive shaft 24 is journalled in the mounting plate 12 and this is driven from an electric motor 25 (FIG. 1) within the bottom housing 11 of the machine by a drive belt or chain 26 extending around a pulley or chain wheel 27 on the shaft 24 and a sprocket 28 on shaft 29 of the motor 25. A gear 30 on the main drive shaft 24 meshes with a first large diameter gear 31 which is secured to the tired support roller 14 to provide for the latter to be rotated from the electric motor 25. A further gear 32 on the main drive shaft 24 meshes with a gear 33 on a shaft 34 journalled in the mounting plate 12 and having a sprocket 35 secured thereon.

A chain 36 extends around the sprocket 35 and around a sprocket 37 mounted by way of a friction clutch 38 upon the take-up spindle 20. This arrangement provides, of course, for the take-up reel 19 to be driven from the electric motor 25 so as to wind up the web 18 at the same speed as it passes around the support roller 14.

Three printing heads 39, 40 and 41 are mounted on the mounting plate 12 at closely-spaced intervals around an upper part of the support roller 14 as can be seen from FIG. 1. Each such printing head comprises a respective printing roller 42, 43, 44 mounted upon a respective printing roller shafts 45, 46, 47 journalled in and projecting to the other side of the mounting plate 12 and carrying a respective gear 48, 49, 50 which is mounted so as to be rotatable relative to the respective shaft 45, 46, 47 and which meshes with a second large diameter gear 81 secured to the shaft 13 so that the three gears 48, 49, 50 are rotated continuously from the electric motor 25. Associated with each printing roller 42, 43, 44 is a respective inking arrangement comprising a respective inking roller 51, 52, 53 mounted on a respective spindle 54, 55, 56 journalled in a respective pair of links 57, 58, 59 swingably mounted upon a respective post 60, 61, 62 projecting from the mounting plate 12. Each of the inking rollers 51, 52, 53 has a respective gear (of which only gear 63 is visible in FIG. 3 of the drawings) meshing with a respective gear 64, 65, 66 freely rotatably located on the printing roller shafts 45, 46, 47 of the respective printing rollers 42, 43, 44 and meshing with the first large diameter gear 31. A respective knurled screw 67, through a respective angled bracket 68 formed integrally with the respective post 60, 61, 62, abuts a corresponding one of the respective links 57, 58, 59 to load the inking rollers 51, 52, 53 towards engagement with the respective printing rollers 42, 43, 44.

Each of the pairs of links 57, 58, 59 locates therebetween a respective ink blade 69 (FIG. 3), a small mass of ink 70 lying in the angle between the blade 69 and the respective inking roller 51, 52, 53 so as to apply a uniform ink coating on the outer curved surface of the inking roller 51, 52, 53 as the latter rotates in the direction indicated by the arrow 71 (FIG. 3) for applying ink, by transfer, to electrotypes or cliches 72 carried by each of the printing rollers 42, 43, 44.

Each printing roller 42, 43, 44 is mounted, with its axis substantially horizontal, so as to be spaced away from the periphery of the support roller 14 by a very small distance approximately equal to or slightly less than the thickness of stereotypes 72, which are of rubber or metal and are carried by each printing roller 42, 43, 44 at two diametrically-opposed positions. These stereotypes 72 constitute, of course, impressions of respective data to be printed by the printing rollers 42, 43, 44, and it is to be understood that each printing roller 42, 43, 44 may be replaced by respective rollers each carrying three respective cliches or electrotypes 72.

As already described, each printing roller 42, 43, 44 is fixedly mounted upon one end of the respective printing roller shaft 45, 46, 47 which is journalled in the mounting plate 12, the shafts 45, 46, 47 of the three printing rollers 42, 43, 44 each being equispaced from the axis of the support roller 14. The second large diameter gear 81 constitutes a printing roller main drive gear and is mounted upon the shaft 13 at the rear of the vertical mounting plate 12, remote from the support roller 14. This printing roller main drive gear 81 is in constant mesh with the printing roller gears 48, 49, 50 of which a respective one is rotatably mounted upon each of the printing roller shafts 45, 46, 47.

Figure 3:
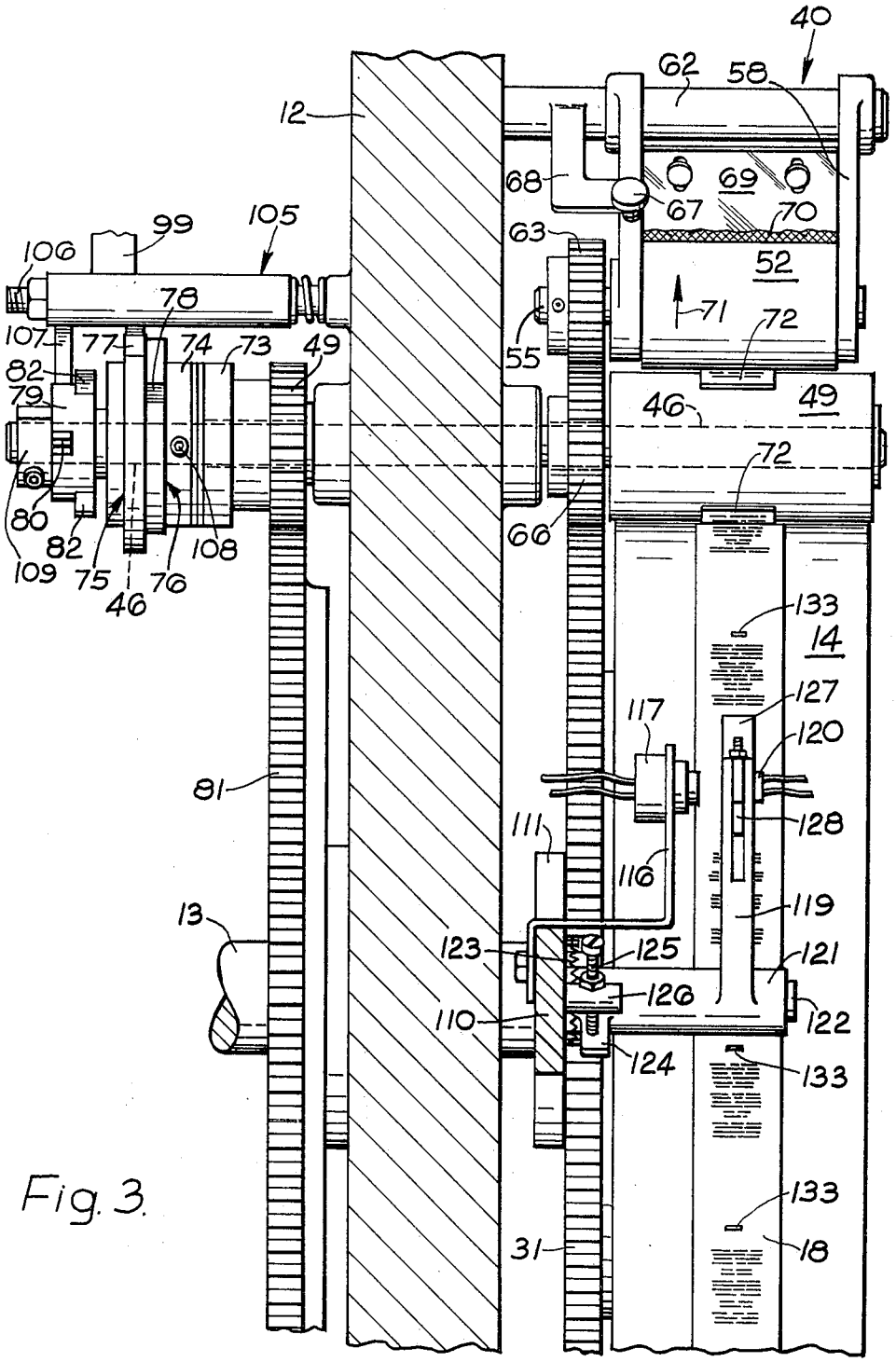
FIG. 3 is an enlarged fragmentary part-sectional end view taken approximately as indicated by line III—III of FIG. 1 showing the details of one of the printing heads of the machine and its respective drive mechanism.

As can be seen from FIG. 3, each such printing roller gear 48, 49, 50 is connected to a respective rotatable first clutch disc 73 forming one half of a respective friction clutch, of which the other half is constituted by a second clutch disc 74 secured to or integral with a respective pair of toothed discs 75, 76, which second clutch disc 74 is fixed on the respective printing roller shaft 45, 46, 47. The toothed disc 75 has two diametrically opposed ratchet teeth 77 on its periphery and the toothed disc 26 has three equispaced ratchet teeth 78 around its periphery. The rotatable clutch disc 73 and the corresponding second clutch disc 74 are in frictional engagement with one another so that in the absence of any restraint upon the second clutch disc 74 rotation of the printing roller gear 81 results in the second clutch disc 73, the printing roller shafts 45, 46, 47 and the printing rollers 42, 43, 44 all being correspondingly rotated.

The printing shafts 45, 46 of the first and second printing rollers 42, 43 (i.e. the printing rollers first and second encountered by the label stock web 18 as it is progressed around the support roller 14) each have secured thereto a respective cam disc 79, these each having a pair of diamertically-opposed cam lobes 80, and, axially displaced relative thereto by the same distance as the teeth 77 are spaced from the teeth 78 axially, three equispaced lobes 82.

A respective pawl for engagement with the one or the other of the toothed disc 75, 76 of the first printing roller 42 is provided by one arm 83 of a first bell crank lever 84 mounted by a pivot 85 on the mounting plate 12, the other arm 86 being connected by a link 87, loaded by a spring 88, to the armature 89 of a solenoid 90, so that energisation of the solenoid 90 disengages the pawl 83 from the toothed disc 75 or 76 to permit the first printing roller 42 to rotate. A stop, into engagement with which the spring 88 loads the arm 86, is provided by a screw 91 through a tongue 92 carried by the mounting plate 12, and the bell crank lever 84 is shiftable axially on the pivot 85 to provide for the pawl 83 to be selectively engaged with the one or the other of the toothed discs 75, 76.

A respective pawl for the toothed discs 75, 76 of the second printing roller 43 is provided by one arm 93 of a second bell crank lever 94 mounted by pivot 95 on the mounting plate 12, the other arm 96 constituting a cam follower disposed to co-operate with one or the other of sets of lobes on the cam disc 79 on the first printing roller shaft 45, so that upon rotation of the first printing roller shaft 45, the lobes on the cam disc 79 thereon serve to pivot the second bell crank lever 94 to disengage the second pawl 93 from the second toothed disc 75 or 76 to permit the second printing roller 43 to rotate.

A radial tongue 99 formed integrally with the bell crank lever 94 is loaded by a spring-loaded plunger 100 to ensure that the pawl 93 and cam follower 96 are loaded towards respective positions in the paths respectively of the ratchet teeth 77 or 78 and the lobes 80 or 82. The plunger 100 is mounted in a bracket 101 secured to the mounting plate 12 and opposed set screws 102 and 103 in the bracket 101 serve to limit the possible pivotal movement of the bell crank lever 94.

Similarly a respective pawl for the toothed discs 75, 76 of the third printing roller 44 is provided by one arm of 104 of a third bell crank lever 105 mounted by pivot 106 on the mounting plate 12, the other arm 107 thereof being a cam follower disposed to co-operate with the cam disc 79 on the second printing roller shaft 46, so that upon rotation of the second printing roller shaft 46, the cam disc 79 thereon pivots the third bell crank lever 105 to disengage the third pawl 104 from the third toothed discs 75, 76 to permit the third printing roller 44 to rotate.

The third bell crank lever 105 has its respective radial tongue 99, plunger 100, bracket 101 and set screws 102, 103.

It will be understood that the bell crank levers 94 and 105 are shiftable axially on their respective pivots 95 and 106 in exactly the same way as the bell crank lever 84 is shiftable so that in the one position of such bell crank levers 84, 94 and 105 the pawls 83, 93 and 104 co-operate with the toothed discs 76 each having three ratchet teeth 78 thereon and the cam followers 96 and 107 each co-operate with the three lobes 82 on the respective cam discs 79. This position of the bell crank levers 84, 94 and 105 is employed when use is made of printing rollers 42, 43 and 44, each having three electrotypes 72 thereon. In the illustrated case, where the printing rollers 42, 43 and 44, the bell crank levers 84, 94 and 105 are shifted to their other position which is as shown in the drawings wherein the pawls 83, 93 and 94 co-operate with the toothed discs 75 each having two ratchet teeth thereon and the cam followers 96 and 107 each co-operate with the two lobes 80 on the respective cam discs 79.

The relative orientations of the printing rollers 42, 43 and 44 and the respective second clutch discs 74 together with their toothed disc 75, 76 are adjustable by adjustment of the orientation of the second clutch discs 74 on their respective printing roller shafts 45, 46, 47 by means of respective clamping screws 108. Similarly, the orientations of the two cam discs 79 and the respective toothed discs 75, 76 on the two printing roller shafts 45 and 46 are adjustable by means of respective pinch clamps 109.

A radial arm 110 is mounted by a boss 111 on one end thereof so as to be swingable about the axis provided by the horizontal shaft 13. A clamping bolt 112 through a slot 113 adjacent the other end thereof extends also through a slot 114 in a clamp plate 115 secured to the mounting plate 12 and thereby provides for the arm 110 to be clamped in a desired angular position relative to the support roller 14. The radial arm 110 carries a Z-bracket 116 at the upper end of which is a photoelectric cell 117 which is aligned with a aperture 118 through a sensor lever 119 adjacent its outer end in register with a light source 120 (FIG. 3) carried by said lever 119. The lever 119 is pivotally mounted, by a boss 121, on a pivot pin 122 carried by the radial arm 110 and is loaded, by a spring 123 connected to a radial tongue 124 integral with the boss 121, in a clockwise direction as viewed in FIG. 1, to the illustrated rest position wherein the radial tongue 124 abuts an adjusting screw 125 through a peg 126 fixed to the radial arm 110 and wherein a shoe 127 at the upper end of the lever 119 is spaced slightly from the confronting surface of the support roller 14. Obviously, the spacing of the shoe 127 from the roller 114 can be adjusted by the screws 125.

The upper end of the sensor lever 119 is bifurcated or slotted to accommodate a shutter element 128 which is pivotally located in place by an eccentric screw 129 and includes a tail portion 130 which, in the illustrated position of the element 128 as defined by abutment thereof against an adjusting screw 131, registers with the aperture 118 and prevents impingement of light from the source 120 on the photoelectric cell 117. The shutter element 128 is so weighted that it assumes the illustrated position under the influence of gravity and that a light anti-clockwise (as viewed in FIG. 4) force, applied to a tip portion 132 thereof protruding at the shoe 127, will pivot such element 128 to move the tail portion 130 out of register with the aperture 118 thereby to cause the photoelectric cell to be energised by the light from the source 120.

Figure 4:
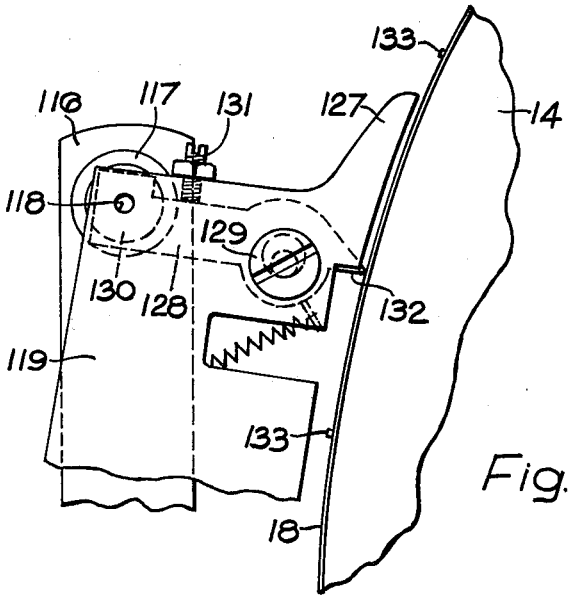
FIG. 4 is an enlarged fragmentary detail of part of FIG. 1.

As is well known, in continuous woven label stock it is quite usual to include, at the termination of each label, a thickened woven-in bar 133 of a plurality can be seen in FIGS. 3 and 4. The tip portion 132 of the shutter element 128 is disposed so as to register with the path of movement of these bars 133 so as to be deflected by momentarily being pivoted upwards against the weight of the element 128, upon the passage of each successive bar 133, thereby to energise the photoelectric cell 117 which in turn serves to energise the solenoid 90.

The operation of the machine will readily be understood from the foregoing description. The support roller 14 operates, of course, to progess the label stock continuously through the printing station constituted by the three printing heads 39, 40 and 41 and each time an individual label to be printed approaches such station one of the woven-in bars 133 (conveniently the woven-in bar 133 of the next succeeding label) in the stock engages with the tip 132 of the shutter element 128 to cause momentary energisation of the solenoid 90. This causes the first pawl 83 to be disengaged momentarily from the periphery of the toothed disc 75 of the first printing roller 42 to disengage from one tooth 77 thereof and then to be re-engaged with the periphery of such toothed disc 75 to engage in due course with the other tooth 77 thereof. As a result, the first printing roller 42 is permitted to perform one half of a revolution and produce its respective impression on the label to be printed.

Such rotation of the first printing roller 42 is accompanied by rotation of the first cam disc 79 and one of the lobes 80 thereof acts upon the arm 96 of the second bell crank lever 94 to displace the latter momentarily against the loading of its plunger 100, thereby to disengage the second pawl 93 momentarily from the periphery of the toothed disc 75 of the second printing roller 43 to disengage from one tooth 77 thereof and then to re-engage it with the periphery of such toothed disc 75 to engage in due course with the other tooth 77 thereof. As a result, the second printing roller 43 is permitted to perform one half of a revolution and produce its respective impression on the label being printed, the register having been adjusted by adjustment of the orientations of the clutch discs and cam discs on their respective shafts as already mentioned.

In a precisely similar manner, the rotation of the second printing roller 43 and its second cam disc 79 causes disengagement of the third pawl 104 momentarily from the periphery of the third toothed disc 75 to permit rotation of the third printing roller 44 to produce its respective impression.

The cumulative effect of the rotation of the three printing rollers is, therefore, to produce three successive impressions in their respective colours, in respective desired locations or dispositions on each of the successive labels in the label stock web 18, the web 18, after printing, being wound up at the take-up reel 19.

In practice, the machine as described can be run at very high speeds, for example up to about 400 labels per minute, and will produce accurately registered impressions upon the successive labels in the stock, regardless of differences (which are not avoidable) in the lengths of the successive woven labels.

The invention is not confined to the precise details of the foregoing example and variations may be made different Thus, it will readily be understood that it is not essential that the machine should be capable of printing differnt coloured impressions and it will generally be constructed to print one, two or three colours, although a larger number of printing heads would be possible, the maximum number of colours being determined by the available space for accommodating the corresponding printing heads. Naturally, different mechanisms for initiating operation of the first printing roller and the successive operations of the succeeding printing rollers can be employed from those described (and of course no such mechanism will be necessary where single colour overprinting is involved) and different arrangement can be employed for progressing the woven label stock through the printing station.

It is, of course, possible to vary the number of stereotypes provided on the printing rollers, in which case it is necessary to provide for the toothed wheels and cam discs to have as many lobes as there are stereotypes on the respective printing roller, so that rotation of each printing roller sufficient to perform a respective single printing operation is sufficient to initiate appropriate rotation of the next printing roller. In the illustrated case there are two stereotypes on each printing roller and the arrangement is such that printing rollers each having three stereotypes can be substituted, but of course this can be varied.

It will be observed from FIG. 1 that in the case of the illustrated machine, a shutter 134 is provided on the main drive shaft 24 and this co-operates with a secondary photoelectric device 135. This arrangement, which is optional, enables the machine to be set up in the first instance without needing to make use of woven label stock which probably would be spoilt in the initial stages. Setting up is therefore effected, initially, using a relatively cheap paper tape in the place of the label stock, and with the photoelectric device 135 switched on in the place of the photoelectric cell 117, so that the printing heads 39, 40, 41 are actuated to produce their respective impressions on the paper tape each time the shutter 134 operates the photoelectric device 135. Inspection of such impressions enables appropriate adjustments to be effected, at each printing head, of the toothed discs 75, 76 and cam device 79 to obtain appropriate registrations, relative to one another, of such impressions on the paper only then is the woven label stock threaded in for overprinting.

It will be understood, of course, that with the shutter 134 and photoelectric arrangement 135 available on the machine, the latter can, if desired, be used for printing continuous strip material at regular intervals but without registration, so the strip material would have to be plain.

I claim:

1. A machine for overprinting continuous woven label stock comprising:

a printing station, a support for supporting the woven label stock and progressing it past the printing station, the printing station including a printing head consisting of a printing roller carrying an impression of data to be printed and an inking arrangement, a drive means for the printing roller sufficiently for a single printing operation upon the passage of each label of the woven label stock through the printing station, a sensor means for initiating the driving of the printing roller through the sensing of a datum mark on each label of the woven label stock, a separate printing head for each color to be printed, each printing head including a respective printing roller carrying a respective impression of the respective data to be printed and a respective inking arrangement, the printing rollers being driven successively and sufficiently for respective single printing operations upon te passage of each label through the printing station, the driving of the first of the printing rollers being initiated by the sensor means serving to sense the datum mark on each label, and the driving of each succeeding printing roller being initiated from the rotation of the preceding printing roller.

2. A machine as claimed in claim 1, wherein each printing roller comprises a respective continuously-driven element adapted to drive its respective printing roller by way of a respective clutch including a ratchet toothed disc which rotates with its printing roller and a respective pawl which cooperates with te toothed wheel and disengages therefrom to permit rotation of the printing roller for each successive single printing operation.

3. A machine as claimed in claim 2, wherein the pawl of the first printing roller is adapted to be disengaged from its toothed disc by the sensor means.

4. A machine as claimed in claim 3, wherein the pawls of the succeeding printing rollers are adapted to be disengaged from their respective disc by respective cam lobes on the disc of the preceding printing roller.

5. A machine as claimed in claim 1, wherein the support for supporting the label stock comprises a resilient roller of diameter substantially greater than the diameters of the printing rollers.

6. A machine as claimed in claim 1, wherein the sensor means comprises a photoelectric sensor adapted to energize a solenoid to initiate driving of the printing rollers.

7. A machine as claimed in claim 6 including a secondary photoelectric cell arrangement adapted to be rendered operative in the place of the photoelectric sensor and to initiate driving of the printing rollers upon each rotation of a driven member of the machine.

* * * * *